US006371797B1

(12) United States Patent
Kikuchi et al.

(10) Patent No.: US 6,371,797 B1
(45) Date of Patent: Apr. 16, 2002

(54) CONNECTOR HAVING AN INCREASED RELIABILITY AND IMPROVED OPERATION PROPERTIES

(75) Inventors: Masayuki Kikuchi, Oume; Tomohiko Tamada, Hamura, both of (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 09/406,669

(22) Filed: Sep. 27, 1999

(30) Foreign Application Priority Data

Sep. 30, 1998 (JP) ..... 10-277416

(51) Int. Cl.[7] ..... H01R 12/24
(52) U.S. Cl. ..... 439/496; 439/67; 439/495
(58) Field of Search ..... 439/495, 496, 439/67, 77

(56) References Cited

U.S. PATENT DOCUMENTS 4,449,773 A * 5/1984 Esser et al. ..... 439/590
5,620,329 A * 4/1997 Kidd et al. ..... 439/248
5,906,504 A * 5/1999 Igarashi et al. ..... 439/495
6,000,950 A * 12/1999 Kajinuma ..... 439/60

FOREIGN PATENT DOCUMENTS

JP 10-22010 1/1998
JP 10-277416 9/1998

* cited by examiner

*Primary Examiner*—P. Austin Bradley
*Assistant Examiner*—Ann McCamey
(74) *Attorney, Agent, or Firm*—Michael Best & Friedrich LLC; J. Warren Whitesel

(57) ABSTRACT

In a connector device for use in connecting a connecting member (20) which has an end portion provided with a conductive portion, a plug connector (10) is removably coupled to a receptacle connector (30) by fitting therebetween. In the plug connector, an insulator (1) defines a receiving space (1*a*) for receiving the end portion of the connecting member. A conductive contact (3) is held in the insulator and formed to become in contact with a receptacle-side contact (33) of the receptacle connector when the plug connector is coupled to the receptacle connector. A slider member (5) is slidably inserted in the receiving space to make the conductive portion be brought in contact with the conductive contact in the receiving space.

8 Claims, 5 Drawing Sheets

CONNECTOR HAVING AN INCREASED RELIABILITY AND IMPROVED OPERATION PROPERTIES

BACKGROUND OF THE INVENTION

The present invention relates to a connector device for use in connecting a sheet-like connecting member such as a flexible printed circuit (FPC) and a flexible flat cable (FFC) of a flat plate shape. The connector device is usable to connect a key board and a mother board in a personal computer to each other.

With reference to FIGS. 5 and 6, a description will be made as regards a connector according to a first earlier technology. The connector comprises an insulator 101, a conductive contact 103 held in the insulator 101, and a slidably arranged slider member 105 which introduces an end of a sheet-like connecting member 120 into the insulator 101 and brings the connecting member 120 into contact with the contact 103.

The slider member 105 has a working portion 107. The insulator 101 has a receiving space 101*a* which receives an end of the connecting member 120 and the working portion 107. The contact 103 comprises a fixed portion 103*a* held in the insulator 101, a retaining portion 103*b* extending from the fixed portion 103*a* along the upper wall of the insulator 101, a contact spring 103*c* extending from the fixed portion 103*a* in the same direction as retaining portion 103*b*, and a terminal 103*d* extending from the fixed portion 103*a* to the outside of the insulator 101 mounted onto a circuit board 130. The terminal 103*d* Is connected to an electric circuit on the circuit board 130. A contact portion 103*g* is formed at an end of the contact spring 103*f*.

As shown in FIG. 5, the working portion 107 of the slider member 105 is inserted between the retaining portion 103*b* and the contact spring 103*c* together with the connecting member 120. When the end of the inserted connecting member 120 bears on the working portion 107, the contact portion 103*f* of the contact spring 103*c* is pressed against the conductive portion of the connecting member 120 to make electric contact with it.

The connecting member 120 can be pulled out of the insulator 101 by withdrawing the slider member 105 from the receiving space 101*a* of the insulator 101, thereby relieving the pressing force of the working portion 107, as shown in FIG. 6 (see, for example, Japanese Unexamined Patent Publication H10-22010).

However, the connector requires handling of the slider member 105 every time the connecting member 120 is inserted and pulled out. Also, it has a problem that the flexible conductive portions of the connecting member 120 can be damaged by repeated inserting and pulling out of the connection member, leading to a deteriorated electric contact. This especially applies to a contact processed by press punching, since the rupture surface by punching which in this case serves as the contact surface will easily damage the conductive portions.

With reference to FIG. 7, a second earlier technology will be described. The second earlier technology comprises a plug connector 150 and a receptacle connector 160. The plug connector 150 is connected by soldering to an end of a connecting member 120 which is the same as the connecting member 120 shown as the first earlier technology. The plug connector 150 comprises an insulator 151 and a conductive contact assembled with the insulator 151. In the illustrated example, contact portions of the contact are arranged at a fitting portion 151*a* of the insulator 151, terminals 155 of the contact being soldered to conductive portions of the connecting member 120.

The receptacle connector 160 is mounted onto a circuit board which is not shown. The receptacle connector 160 comprises a mating insulator 161 and a conductive mating contact 163 assembled with the mating insulator 161. In the illustrated example, mating terminals 164 of the mating contact 163 are soldered to conductive portions of a circuit board which are not shown.

The plug connector has a problem that it requires much man-hour in connecting operation, since the terminals 155 have to be soldered to the conductive portions of the connection member 120. Further, it has problem that pulling out of the plug connector from the receptacle connector 160 by hand severely stresses the terminals 155 of the plug connector 150, giving rise to a damage in the connecting portions.

SUMMARY OF THE INVENTION

It is therefore an object of the present invention to provide a connector device which has an increased reliability and improved operation properties.

Other objects of the present invention will become clear as the description proceeds.

According to the present invention, there is provided a connector device for use in connecting a connecting member which is of a flat plate shape and has an end portion provided with a conductive portion. The connector device comprises a receptacle connector including a receptacle-side contact and a plug connector removably coupled to the receptacle connector by fitting therebetween for electrically connecting the connecting member with the receptacle connector. The plug connector comprises an insulator defining a receiving space for receiving the end portion of the connecting member, a conductive contact held in the insulator and formed to become in contact with the receptacle-side contact when the plug connector is coupled to the receptacle connector, and a slider member slidably inserted in the receiving space to make the conductive portion be brought in contact with the conductive contact in the receiving space.

DESCRIPTION OF THE PREFERRED EMBODIMENTS

Figure 1:
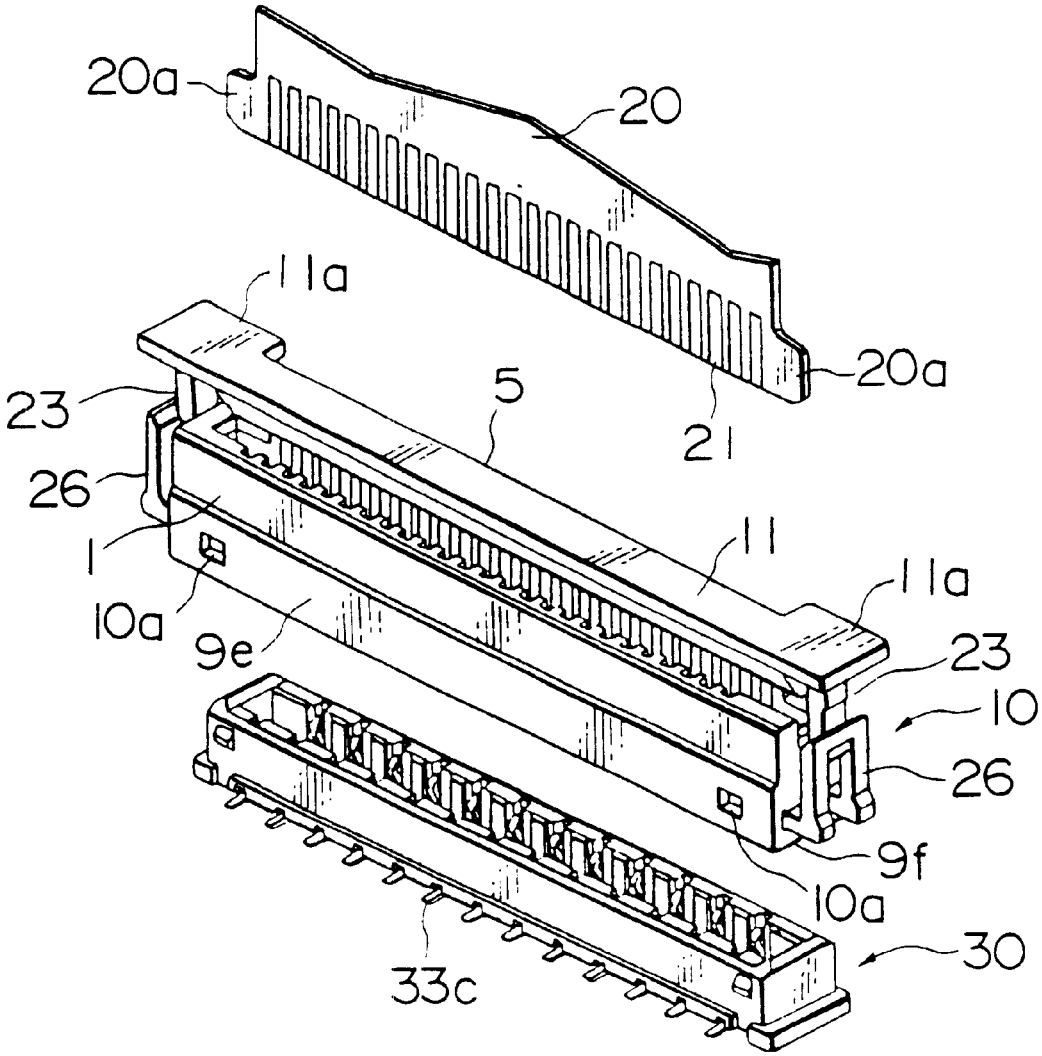
FIG. 1 is an exploded perspective view showing a connector device according to an embodiment of the present invention.
Figure 2:
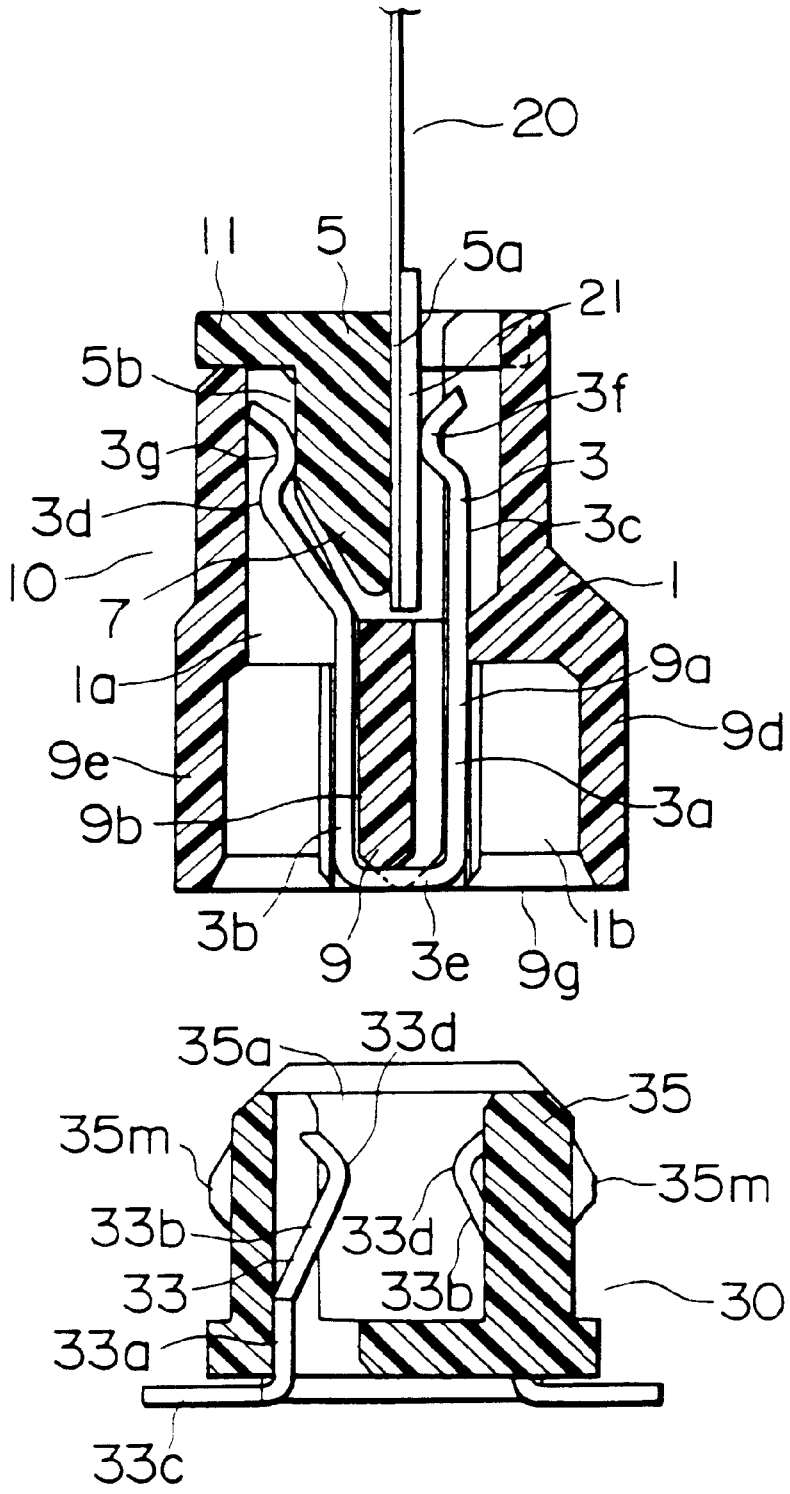
FIG. 2 is a sectional view of the connector device of FIG. 1, wherein a connecting member is connected to a plug connector.

With reference to FIGS. 1 and 2, the description will be made as regards a connector device according to an embodiment of the present invention.

The connector device is for use in connecting a sheet-like connecting member 20 such as a FPC and a FFC of a flat plate shape. The connecting member 20 has a plurality of conductive portions 21 arranged parallel to each other with a predetermined interval therebetween. The connector device comprises a receptacle connector 30 and a plug connector 10 for being connected between the receptacle connector 30 and the connecting member 20.

The plug connector 10 comprises an insulator 1 having substantially rectangular box shape, a plurality of conductive contacts 3 held in the insulator 1, and a slider member 5 slidably arranged in the insulator 1. The contacts 3 are arranged in the insulator 1 in parallel to each other with the predetermined interval therebetween.

The slider member 5 comprises a working portion 7 having a contacting surface 5*a* for contacting to the connecting member 20 and a pressing surface 5*b* opposite to the contacting surface 5*a*. The insulator 1 defines a receiving space 1*a* and a fitting portion or a fitting space 1*b* and comprises a retaining wall 9 formed in the fitting space 1*b*. The receiving space 1*a* is for receiving an end portion of the connecting member 20 and the working portion 7 of the slider member 5. The fitting space 1*b* is for detachably fitting over the receptacle connector 30.

Figure 3:
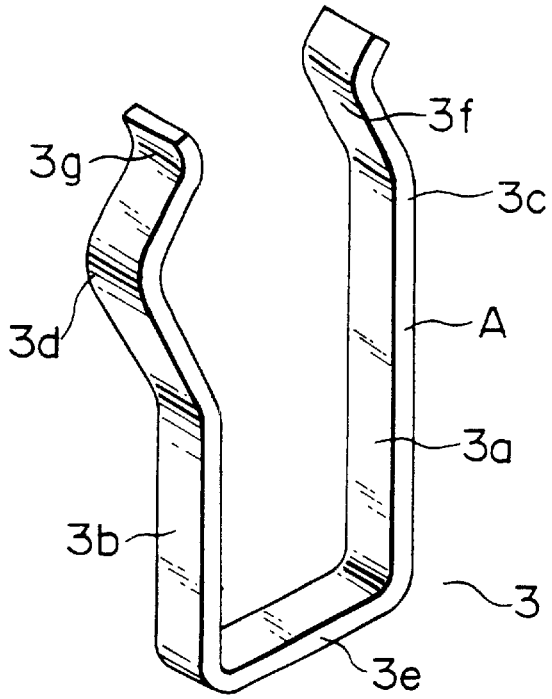
FIG. 3 is an enlarged perspective view of a contact included in the plug connector shown in FIG. 1.

Referring to FIGS. 2 and 3, each contact 3 (FIG. 3) comprises a pair of retained portions 3*a* and 3*b*, a pair of spring portions 3*c* and 3*d*, and a connecting portion 3*e*. The retained portions 3*a* and 3*b* are held on a pair of opposite retaining surfaces 9*a* and 9*b* (FIG. 2) of the retaining wall 9, respectively. The retained portions 3*a* and 3*b* are for becoming in contact with conductive receptacle-side or mating contacts 33 held in the receptacle connector 30. The spring portions 3*a* and 3*d* are connected to respective ends of the retained portions 3*a* and 3*b* and extend to face each other within the receiving space 1*a*. The connecting portion 3*e* is connected between the other ends of the retained portions 3*a* and 3*b*. The overall side view of the retained portions 3*a* and 3*b* and the connecting portion 3*e* substantially assumes an U-shape.

The retaining wall 9 is arranged longitudinally between and at the center of a pair of parallel side walls 9*d*, 9*e* extending in the longitudinal direction of the insulator 1. The retaining wall 9 extends from the open end of the fitting space 1*b* toward the receiving space 1*a*.

A contact portion 3*f* is formed at the spring portion 3*c* and placed in the receiving space 1*a*. On the other hand, a pressing portion 3*g* is formed at the spring portion 3*d* and placed in the receiving space 1*a*. The connecting member 20 is inserted between the contact portion 3*f* and the pressing portion 3*g* so that the conductive portion 21 faces the contact portion 3*f*. The working portion 7 Is inserted between the pressing portion 3*g* and the conductive portion 21 of the connecting member 20. When the connecting member 20 and the working portion 7 are inserted between the contact portion 3*f* and the pressing portion 3*g*, the pressing portion 3*g* presses the working portion 7 to make the conductive portion 21 be brought in press contact with the contact portion 3*f*. As a result, the contact portion 3*f* is electrically connected to one of the conductive portions 21 of the connecting member 20. In other words, the slider member 5 makes the conductive portions 21 become in contact with the contacts 3, respectively.

Each contact 3 is formed as an elongate plate by press punching a conductive plate followed by bending. The contact portion 3*f* has a material surface or a blank surface which comes in contact with the conductive portion 21 of the connecting member 20. Accordingly, the conductive portion 21 of the connecting member 20 are brought into contact with the material surface of the contact 3, and not with the ruptured surface A made by punching.

Further, the slider member 5 has a handling portion 11 integrated with the working portion 7. Handling projections 11*a* are formed at the handling portion 11. The handling projections 11*a* are engaged with the projections 20*a* formed at both side edges of the end of the connecting member 20. Therefore, the connecting member is prevented from being pulled out when the handling projections rest on the open end surface of the receiving space 1*a* while the connecting member 20 is introduced into the receiving space 1*a* with its end bearing on the contacting bearing surface 5*a*.

Figure 4:
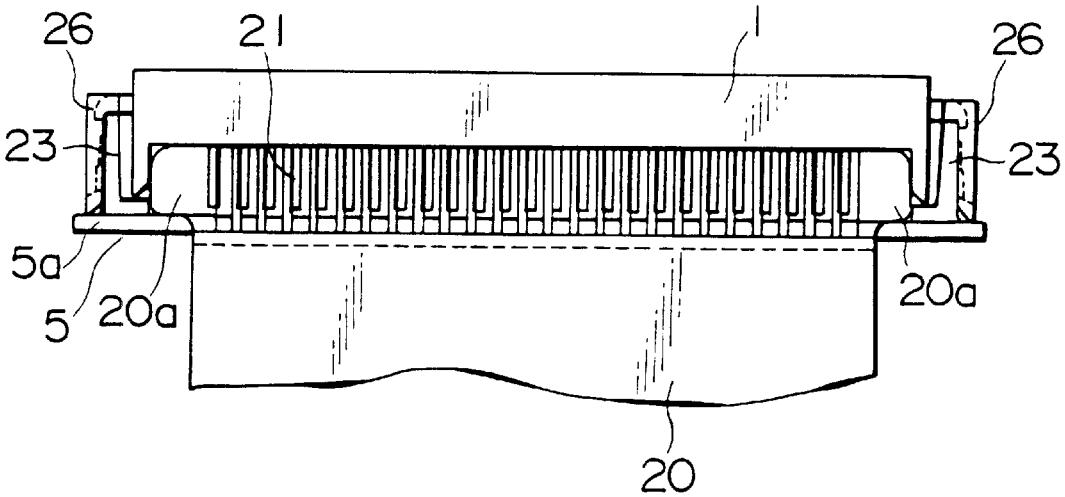
FIG. 4 is a plan view of the plug connector shown in FIG. 2, wherein the connecting member is connected to the plug connector.
Figure 5:
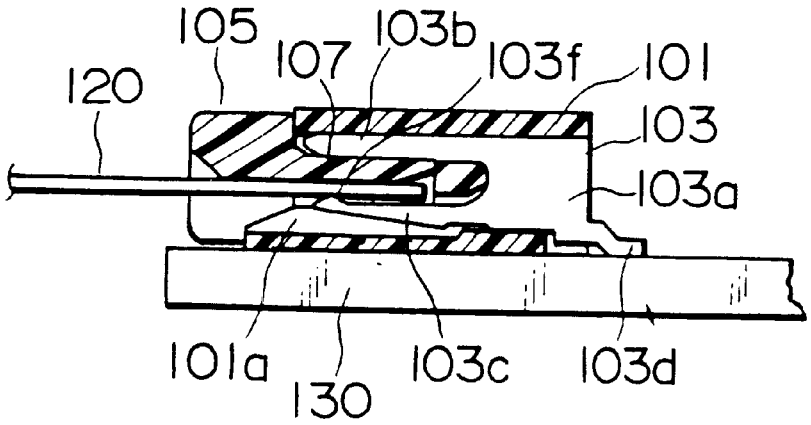
FIG. 5 (PRIOR ART)
FIG. 5 is a sectional view of a connector according to a first earlier technology, wherein a circuit board is installed thereto.
Figure 6:
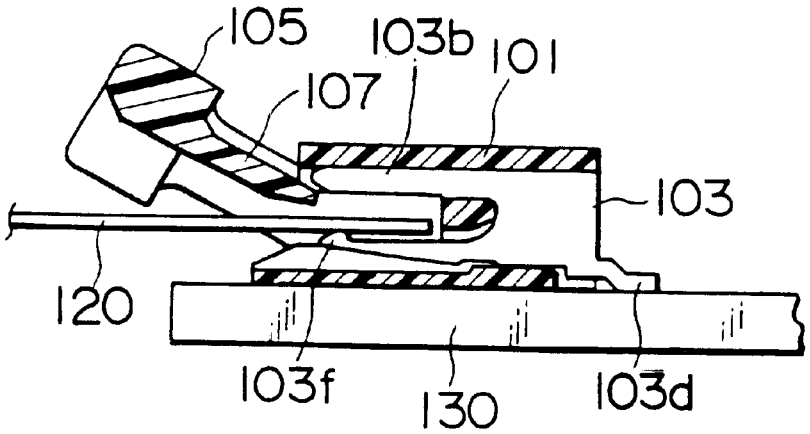
FIG. 6 (PRIOR ART)
FIG. 6 is a sectional view for describing action of the connector of FIG. 5.
Figure 7:
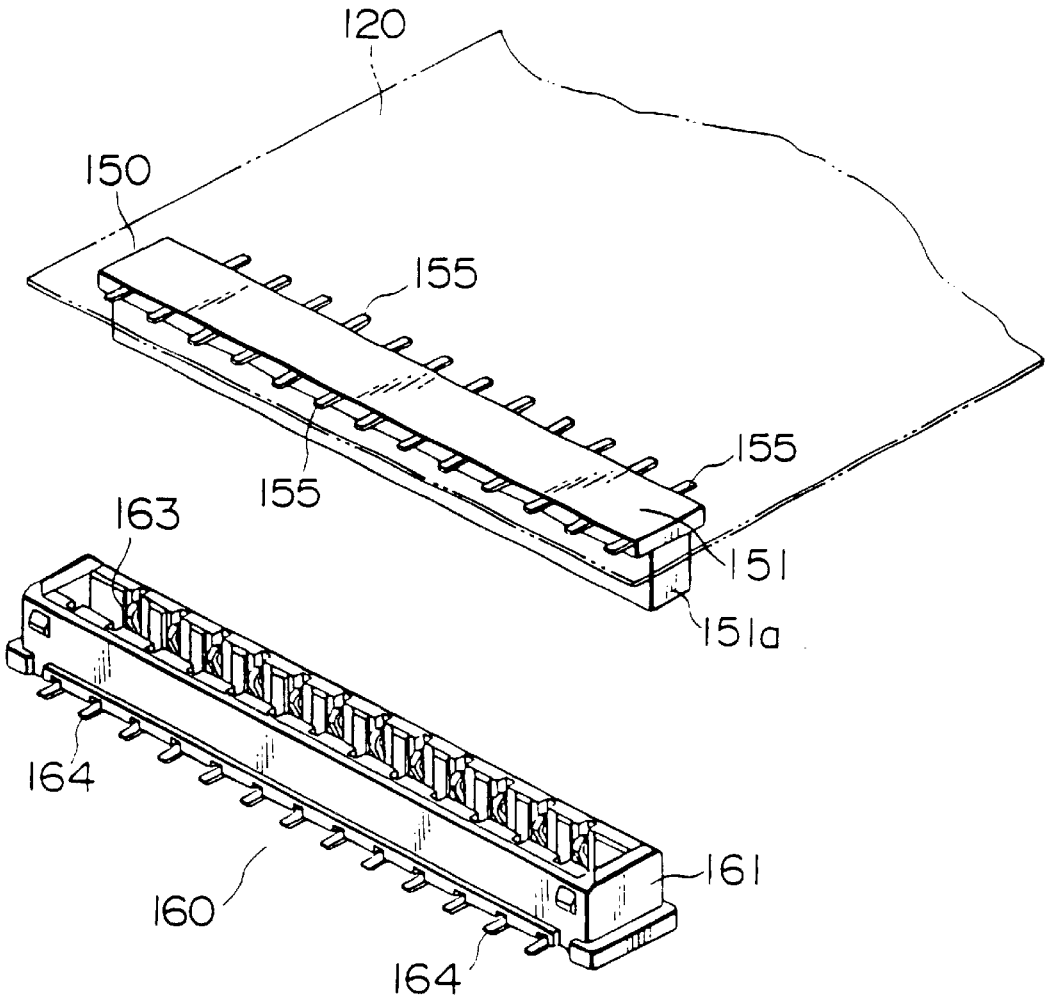
FIG. 7 (PRIOR ART)
FIG. 7 is a sectional view of a connector device according to a second earlier technology.

Referring to FIG. 4 together with FIG. 1, a pair of arms 23 are formed at both sides of the slider member 5. The arms 23 extend along both external side walls of the insulator 1 to be perpendicular to the longitudinal direction of the insulator 1. A pair of arm receptacles 26 is formed at the external side walls of the insulator 1. The arm receptacles 26 have ends connected to the external side walls, respectively. A pair of arms 23 is slidable to be engaged with the arm receptacles 26.

The insulator 1 (FIG. 1 and 2) comprises four side walls 9*d*, 9*e*, 9*f*, and 9*g* surrounding the retaining wall 9 formed at the center of the fitting space 1*b* in such a manner as to come in contact with pairs of the mating contacts 33 arranged symmetrically. Among the four side walls 9*d*, 9*e*, 9*f*, and 9*g*, a pair of opposite side walls 9*d* and 9*e* is provided with a plurality of engaging holes 10*a* formed therein.

Referring to FIGS. 1 and 2 again, the receptacle connector 30 comprises pairs of the mating contacts 33 and a mating insulator 35 which holds the mating contacts 33 and Is mounted on a circuit board (not shown). The mating insulator 35 has a mating fitting space 35*a* which receives the retaining wall 9.

Each mating contact 33 comprises a receptacle-side or mating retained portion 33*a* held at the mating insulator 35, receptacle-side or mating contact springs 33*b* extending from the mating retained portion 33*a* toward the mating fitting space 35*a*, and a receptacle-side or mating terminal 33*c* extending to the outside from the mating retained portion 33*a*. A pair of the mating contact springs 33*b* have a pair of receptacle-side or mating contact portions 33*d* which come in contact with a pair of retained portions 3*a* and 3*b*, respectively, when the fitting space 1*b* is fitted with the mating insulator 35. The mating insulator 35 has a plurality of engaging protrusions 35*m* on each of a pair of mating side walls facing the side walls 9*d* and 9*e*, which engage with the corresponding engaging holes 10*a*.

The connecting member 20 is previously connected to the plug connector 10. Generally, electrical connection or disconnection is carried out between the plug connector 10 and the receptacle connector 30. The projections 20*a* provided at both ends of the conductive portion array 21 of the connecting member 20 are engaged with the slider member 5, while the slider member 5 and the insulator 1 are looked with each other when the connection member 20 is connected. In this way, the conductive portions 21 of the connecting member 20 are free from the influence of a stress even in case the plug connector 10 are pulled by pulling the connecting member 20 by hand.

What is claimed is:

1. A connector device for use in connecting a connecting member which is of a flat plate shape and has an end portion provided with a conductive portion, said connector device comprising:

a receptacle connector including a receptacle-side contact; and a plug connector removably coupled to said receptacle connector by fitting into said receptacle connector for electrically connecting said connecting member with said receptacle connector;

said plug connector comprising:

an insulator defining a receiving space for receiving said end portion of the connecting member, said insulator having a fitting space and a retaining wall in said fitting space;

a conductive contact held in the insulator and formed to come into contact with said receptacle-side contact when said plug connector is coupled to said receptacle connector; and a slider member slidably inserted into said receiving space to bring said conductive portion into contact with said conductive contact in said receiving space;

said conductive contact comprising:

a pair of retained portions facing opposite outer surfaces of said retaining wall, respectively, for coming into contact with said receptacle-side contact;

a connection portion connecting said retained portions together, a combination of said connecting portion and said retained portions making a U-shape portion which is fitted into said receptacle-side contact when said plug connector is coupled to said receptacle connector;

a pair of spring portions connected to said retained portions and extending in said receiving space for receiving portions and extending in said receiving space for receiving said connecting member and said slider member therebetween;

a contact portion formed on one of said spring portions for coming into contact with said conductive portion of the connecting member; and a pressing portion formed on another spring portion for pressing said slider member to bring said conductive portion into press contact with said contact portion.

2. A connector device as claimed in claim 1, wherein said insulator has a fitting portion for removably fitting to said receptacle connector.

3. A connector device as claimed in claim 1, wherein, said insulator has external walls of both sides thereof, said slider member having a pair of arms at both side ends thereof, said arms extending along said external walls, said insulator having a pair of arm receptacles extending from said external walls in such a manner that said arms are slidable to be engaged with them.

4. A connector device as claimed in claim 1, wherein said conductive contact is made of an elongate conductive plate, said contact portion being of material surface of said elongate plate.

5. A connector device as claimed in claim 1, wherein said insulator has a plurality of engaging holes formed in a pair of side walls facing said retaining wall, said receptacle connector further including a receptacle-side insulator which holds said receptacle-side contact and which is mounted on a circuit board, said receptacle-side insulator having a receptacle-side fitting portion which receives said retaining wall;

said receptacle-side contact comprising:

a receptacle-side retained portion held in said receptacle-side insulator;

a receptacle-side contact spring extending from said receptacle-side retained portion towards said receptacle-side fitting portion;

a terminal extending from mating retained portions to the outside; and a receptacle-side contact portion which comes into contact with said pair of retained portions when said fitting portion is fitted with said receptacle-side insulator, said receptacle-side insulator having a plurality of engaging protrusions at a pair of receptacle-side side walls facing said engaging hole in said pair of insulator side walls, which engage with corresponding ones of said engaging holes.

6. A connector device as claimed in claim 1, wherein said connecting member is inserted between said contact portion and said pressing portion, said slider member comprising a working portion being inserted between said pressing portion and said conductive portion of the connecting member.

7. A connector device as claimed in claim 6, wherein said slider member further comprises a handling portion integrated with said working portion for handling said slider member, said handling portion engaging with said connecting member to maintain said connecting member between said contact portion and said working portion.

8. A connector device as claimed in claim 7, wherein said connecting member has projections formed at both sides thereof, said handling portion having projections which engage with the projections of said connecting member in such a manner that said connecting member is prevented from being pulled out when said handling portion rests on an open end surface of said receiving space while said connecting member is inserted between said contact portion and said working portion.

* * * * *

UNITED STATES PATENT AND TRADEMARK OFFICE

CERTIFICATE OF CORRECTION

PATENT NO. : 6,371,797 B1
DATED : April 16, 2002
INVENTOR(S) : Kikuchi et al.

It is certified that error appears in the above-identified patent and that said Letters Patent is hereby corrected as shown below:

Column 1,
Line 31, delete “103g”
Line 30, delete “Is” and insert -- is --

Column 3,
Line 31, delete “3a and 3b are” and insert -- 3a and 3b (Fig. 3) are --
Line 34, delete “3a and 3b” and insert -- 3c and 3d --
Line 52, delete “Is” and insert -- is --

Column 4,
Line 14, delete “contacting bearing surface” and insert -- contacting surface --
Line 24, delete “Fig 1” and insert -- Figs 1 --
Line 33, delete “Is” and insert -- is --
Line 57, delete “looked” and insert -- locked --

Column 5,
Line 46, delete “of” and insert -- on --

Column 6,
Line 29, delete “corresponding Ones of said” and insert -- corresponding said --

Signed and Sealed this

Fifth Day of August, 2003

JAMES E. ROGAN
*Director of the United States Patent and Trademark Office*